US007926588B2

(12) United States Patent
Judzis et al.

(10) Patent No.: US 7,926,588 B2
(45) Date of Patent: Apr. 19, 2011

(54) OPTIMIZING DRILLING PERFORMANCE USING A SELECTED DRILLING FLUID

(75) Inventors: Arnis Judzis, Salt Lake City, UT (US); Alan D. Black, Coral Springs, FL (US); Sidney J. Green, Salt Lake City, UT (US); Homer A. Robertson, West Jordan, UT (US); Ronald G. Bland, Houston, TX (US); David Alexander Curry, The Woodlands, TX (US); Leroy W. Ledgerwood, III, Cypress, TX (US)

(73) Assignees: Terratek Inc., Salt Lake City, UT (US); Baker Hughes, Inc., Houston, TX (US)

( * ) Notice: Subject to any disclaimer, the term of this patent is extended or adjusted under 35 U.S.C. 154(b) by 238 days.

(21) Appl. No.: 12/337,198

(22) Filed: Dec. 17, 2008

(65) Prior Publication Data

US 2009/0152007 A1 Jun. 18, 2009

Related U.S. Application Data

(60) Provisional application No. 61/014,321, filed on Dec. 17, 2007.

(51) Int. Cl.
*E21B 21/00* (2006.01)
*E21B 44/00* (2006.01)
*C09K 8/035* (2006.01)

(52) U.S. Cl. ..... 175/24; 175/57; 175/65; 507/103; 507/145

(58) Field of Classification Search ..... None
See application file for complete search history.

(56) References Cited

U.S. PATENT DOCUMENTS

| | | | | |
|---|---|---|---|---|
| 4,536,297 | A * | 8/1985 | Loftin et al. | 507/121 |
| 6,176,323 | B1 * | 1/2001 | Weirich et al. | 175/40 |
| 6,612,382 | B2 * | 9/2003 | King | 175/40 |
| 7,556,105 | B2 * | 7/2009 | Krueger | 175/45 |
| 2004/0016571 | A1 * | 1/2004 | Krueger | 175/61 |
| 2004/0256152 | A1 * | 12/2004 | Dashevskiy et al. | 175/25 |
| 2006/0021797 | A1 * | 2/2006 | Krueger | 175/61 |
| 2007/0185696 | A1 * | 8/2007 | Moran et al. | 703/10 |

OTHER PUBLICATIONS

Black, Alan D. et al., "Optimization of Deep Drilling Performance with Improvements in Drill Bit and Drilling Fluid Design" IADC/SPE Drilling Conference, Mar. 4-6, 2008, pp. 1-23, IADC/SPE 112731, Orlando, FL, USA.

Judzis, Arnis et al., "Optimization of Deep Drilling Performance: Benchmark Testing ROP Improvements for Bits and Drilling Fluids" SPE/IADC Drilling Conference, Feb. 20-22, 2007, pp. 1-2, SPE/IADC 105885, Amsterdam, The Netherlands.

* cited by examiner

*Primary Examiner* — George Suchfield
(74) *Attorney, Agent, or Firm* — Dan C. Hu; Wavne I. Kanak

(57) ABSTRACT

To improve drilling performance, a drilling fluid is selected based on one or more criteria and to have at least one target characteristic. Drilling equipment is used to drill a wellbore, and the selected drilling fluid is provided into the wellbore during drilling with the drilling equipment. The at least one target characteristic of the drilling fluid includes an ability of the drilling fluid to penetrate into formation cuttings during drilling to weaken the formation cuttings.

21 Claims, 2 Drawing Sheets

OPTIMIZING DRILLING PERFORMANCE USING A SELECTED DRILLING FLUID

CROSS-REFERENCE TO RELATED APPLICATION

This claims the benefit under 35 U.S.C. §119(e) of U.S. Provisional Application Ser. No. 61/014,321, entitled "Optimization of Deep Drilling Performance with Improvements in Drill Bit and Drilling Fluid Design," filed Dec. 17, 2007, which is hereby incorporated by reference.

STATEMENT REGARDING FEDERALLY-SPONSORED RESEARCH OR DEVELOPMENT

This invention was made with Government support under contract DOE DE-FC 26-02NT41657 awarded by the U.S. Department of Energy. The Government has certain rights in the invention.

TECHNICAL FIELD

The invention relates generally to optimizing drilling of a wellbore based on selection of a drilling fluid and having at least one target characteristic.

BACKGROUND

To recover hydrocarbons or other fluids from a subterranean reservoir, one or more wellbores can be drilling into the earth's subterranean formation to intersect the reservoir. The drilling operation is typically performed by using a drill string suspended by a rig, where the drill string is advanced into the subterranean formation to form a wellbore.

The drill string includes a bottom hole assembly that has a drill bit for drilling through the subterranean formation. During a drilling operation, drilling fluid is pumped into the wellbore to cool, clean, and lubricate the drill bit and to carry formation cuttings up to the surface. The flow of drilling fluid is also often used for downhole mud motors.

The efficiency and costs associated with drilling a wellbore are important considerations in improving the economics of hydrocarbon production, development, and/or exploration. Inefficient drilling techniques may slow down the drilling of the wellbore, which can lead to increased drilling times and increased labor and equipment costs.

SUMMARY

In general, according to an embodiment, a method of optimizing drilling performance includes selecting, based on one or more criteria, a drilling fluid having at least one target characteristic. Drilling equipment is used to drill a wellbore, and the selected drilling fluid is provided into the wellbore during drilling. At least one target characteristic of the drilling fluid includes an ability of the drilling fluid to penetrate into formation cuttings.

Other or alternative features will become apparent from the following description, from the drawings, and from the claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments are possible.

In accordance with some embodiments, a technique is provided to improve drilling performance for drilling a wellbore into a subterranean formation. Drilling performance can be improved by selecting a drilling fluid that has a desirable characteristic. One such characteristic is the ability of the drilling fluid to penetrate into formation cuttings during drilling, which can serve to weaken the formation cuttings such that the formation cuttings can more easily be broken up or disintegrated. Other or alternative desirable characteristics may include a drilling fluid that does not increase in viscosity under high pressure, a drilling fluid that does not increase in viscosity with increased shear experienced by the drilling fluid, a drilling fluid that exhibits a chemical-mechanical effect to weaken the formation proximate a drill bit, and a drilling fluid that prevents rehealing of formation cuttings and cut rock. Shear is caused by turbulent fluid flow in the wellbore, which can result in some particles of the fluid being at different velocities than other particles of the fluid. In general, the target characteristics of the drilling fluid include at least two of any of the characteristics listed above.

Figure 1:
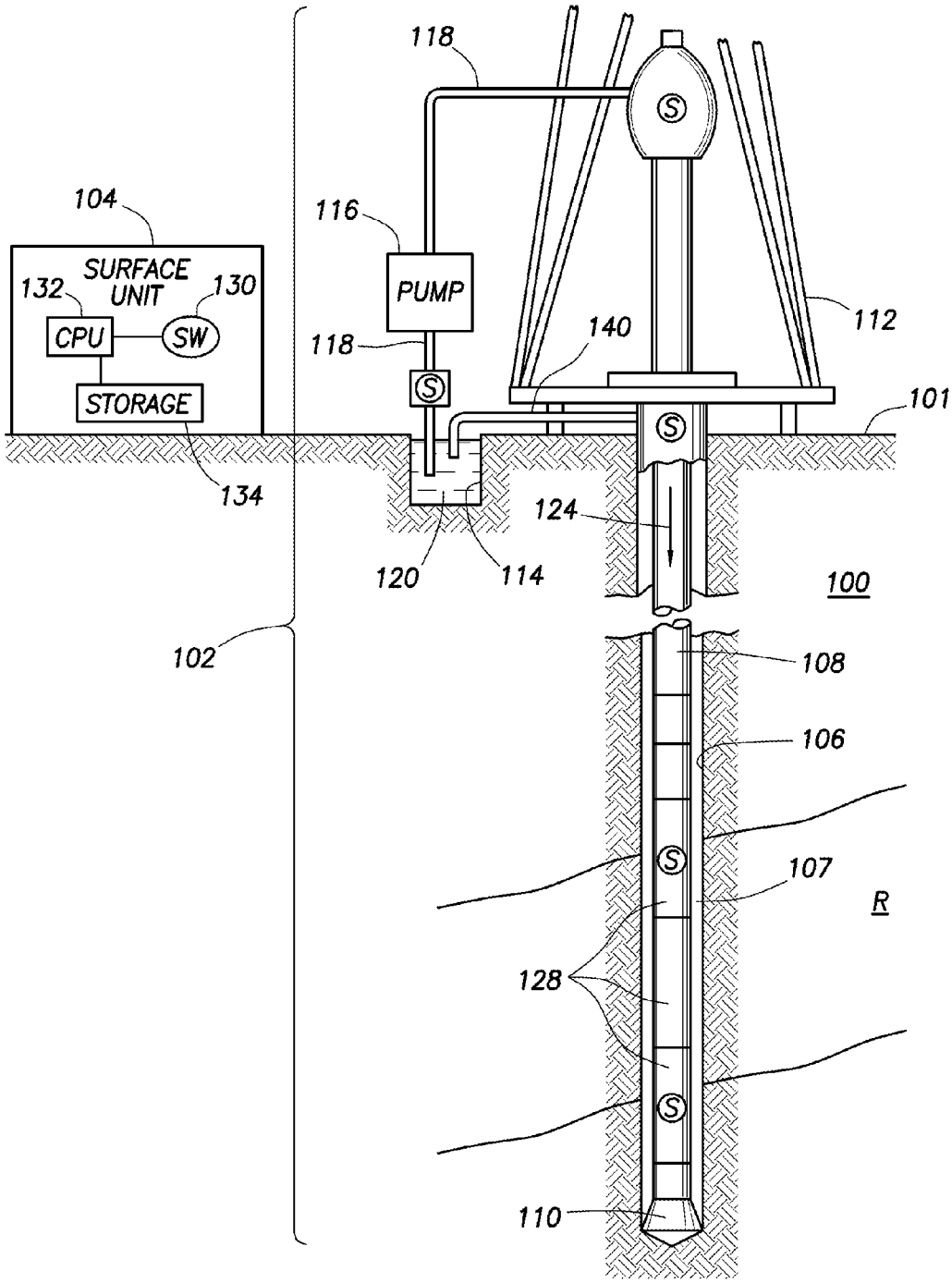
FIG. 1 illustrates an exemplary drilling arrangement for drilling a wellbore into a subterranean formation using a technique according to an embodiment.

FIG. 1 illustrates exemplary drilling equipment 102 for drilling a wellbore 106 through a subterranean formation 100 underneath an earth surface 101. The drilling equipment 102 includes a drill string 108 that is suspended within the wellbore 106 by a rig 112 provided at the earth surface 101. A fluid container 114 is provided to store drilling fluid 120. The fluid container 114 can be a pit in the ground, or alternatively, can be an enclosed container. As depicted in FIG. 1, the drill string 108 has drilled through the formation 100 to form the wellbore 106 that intersects a reservoir R, which can contain hydrocarbons, for example.

A pump 116 delivers the drilling fluid 120 through a conduit 118 to the rig 112. The drilling fluid is delivered into the interior of the drill string 108 through the rig 112. The drilling fluid flows downwardly through the drill string 108, as indicated by an arrow 124. The drilling fluid exits the drill string 108 through ports, jets, or nozzles provided in a drill bit 110 provided at the bottom of the drill string 108. The drilling fluid then circulates upwardly through a well annulus 107 between the outside of the drill string 108 and the inner wall of the wellbore 106. In this manner, the drilling fluid cools, cleans and lubricates the drill bit 110 during a drilling operation. The drilling fluid that is circulated up the well annulus 107 is returned through a return conduit 140 to the fluid container 114 for recirculation. The return flow of the drilling fluid up the well annulus 107 helps remove formation cuttings (formed by operation of the drill bit 110 in cutting through the subterranean formation 100) to the surface.

The drill string 108 can optionally include other components 128, such as sensors and other types of components. Measurements taken by sensors can be communicated to earth surface equipment, such as a surface unit 104, which can be a computer having software 130 executable on one or more central processing units (CPUs) 132 coupled to a storage 134.

Figure 2:
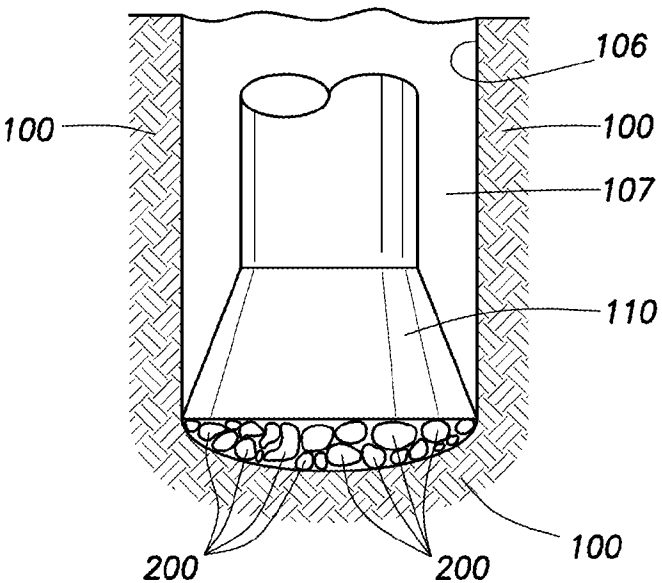
FIG. 2 illustrates a drill bit cutting into a formation.

As further depicted in FIG. 2, as the drill bit 110 drills into the subterranean formation 100 surrounding the wellbore 106, formation cuttings (rock cuttings) 200 are formed. Due to high pressures that typically exist downhole, the rock cuttings 200 may remain as hard as the original rock surrounding the wellbore 106, which means that the drill bit 110 would have to re-cut the rock cuttings 200. This leads to inefficiency in drilling the wellbore 106, which can lead to increased drilling time as well as increased wear on the drill bit 110.

In accordance with some embodiments, a drilling fluid is selected that has a desired characteristic to improve drilling performance (improve the rate of penetration or ROP of the drilling operation). The desired characteristic can include one or more of the following: (1) the drilling fluid has the ability to penetrate into the rock cuttings 200 such that the rock cuttings are weakened or degraded to allow the rock cuttings to be more easily broken up or disintegrated; (2) the viscosity of the drilling fluid does not increase above the viscosity of the drilling fluid at atmospheric pressure (which is typical of low solids, high density fluid such as cesium formate), such that the drilling fluid can remain effective during the drilling operation; (3) the viscosity of the drilling fluid does not increase with shear; (4) the drilling fluid exhibits a chemical-mechanical effect that weakens the surrounding rock (formation) 100; and (5) the drilling fluid prevents rehealing of the formation cuttings 110 as well as the cut rock adjacent the drill bit 110.

The ability of the drilling fluid to penetrate the rock cuttings 200 enables the drill bit 110 to more easily break up the rock cuttings 200. Normally, high downhole pressures (especially in deep wellbores, e.g., wellbores having depths of up to 25,000 feet or greater) tend to push the rock cuttings together after pulverization by the drill bit 110 such that the compacted rock cuttings tend to be just as strong as before the pulverization. Using a properly selected drilling fluid in accordance with some embodiments, the drilling fluid will penetrate and weaken the rock cuttings to counteract the above effect.

Figure 3:
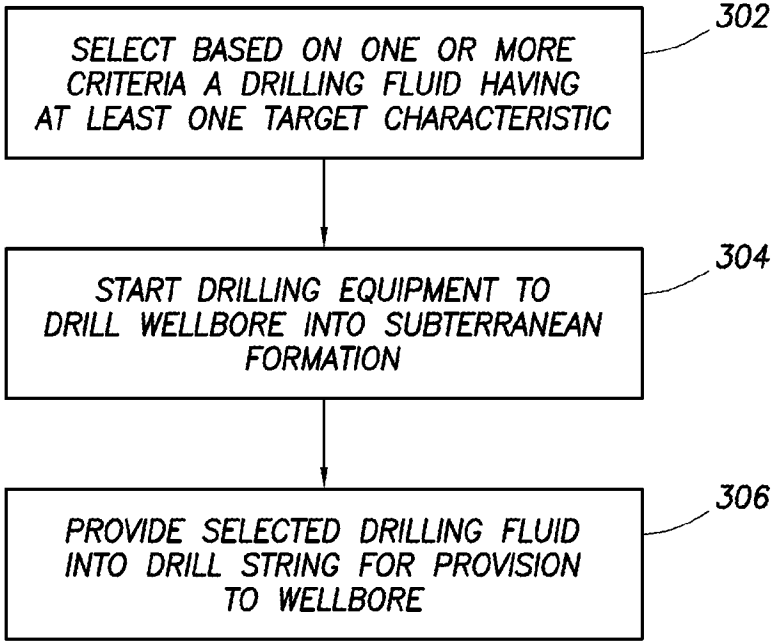
FIG. 3 is a flow diagram of a process of optimizing drilling performance, in accordance with an embodiment.

FIG. 3 illustrates a process according to an embodiment. The process selects (at 302), based on one or more criteria, a drilling fluid having at least one target characteristic. The target characteristic can be any of the characteristics identified above. The one or more criteria can be one or more of: (1) faster drilling by the drill string 108; (2) drilling at high pressures (e.g., pressures in excess of 10,000 pounds per square inch); (3) drilling in a particular formation composition (e.g., limestone, dolomite, sandstone, etc.), (4) and others.

Examples of different types of drilling fluid that can be selected include a drilling fluid containing cesium formate, a drilling fluid containing only mineral oil, or a drilling fluid containing an additive such as manganese tetroxide or another type of metallic oxide. Cesium formate is a clear fluid that contains a relatively small amount of solids.

Selection of the drilling fluid can be accomplished in one of a number of different ways. According to a first technique, the selection of the drilling fluid can be based on laboratory experiments that indicate which types of drilling fluids are optimal for different criteria and the various characteristics of the drilling fluid. Based on such information derived from experimentation, personnel at a job site will be able to intelligently select the appropriate drilling fluid for use in the drilling operation.

Alternatively, the selection of the drilling fluid can be accomplished in an automated manner, such as by use of a computer, such as the surface unit 104 in FIG. 1. The selection of the drilling fluid can be based on input data that includes information relating to the criteria to be considered and the target characteristic of the drilling fluid. Based on the input data, software in the computer (e.g., software 130 in FIG. 1) can be used to automatically select the desired drilling fluid.

Next, drilling equipment is started (at 304) to drill a wellbore into the subterranean formation. During drilling, the selected drilling fluid is provided (at 306) into the drill string for provision to the wellbore proximate the drill bit 110 such that improved drilling performance can be achieved, as described above.

In embodiments in which selection of the drilling fluid is automatically performed by a computer, instructions of software (e.g., software 130 in FIG. 1) to perform such selection can be loaded for execution on a processor (such as one or more CPUs 132 in FIG. 1). The processor includes microprocessors, microcontrollers, processor modules or subsystems (including one or more microprocessors or microcontrollers), or other control or computing devices. A "processor" can refer to a single component or to plural components.

Data and instructions (of the software) are stored in respective storage devices, which are implemented as one or more computer-readable or computer-usable storage media. The storage media include different forms of memory including semiconductor memory devices such as dynamic or static random access memories (DRAMs or SRAMs), erasable and programmable read-only memories (EPROMs), electrically erasable and programmable read-only memories (EEPROMs) and flash memories; magnetic disks such as fixed, floppy and removable disks; other magnetic media including tape; and optical media such as compact disks (CDs) or digital video disks (DVDs).

While the invention has been disclosed with respect to a limited number of embodiments, those skilled in the art, having the benefit of this disclosure, will appreciate numerous modifications and variations therefrom. It is intended that the appended claims cover such modifications and variations as fall within the true spirit and scope of the invention.

What is claimed is:

1. A method of improving drilling performance, comprising:

selecting, based on one or more criteria, a drilling fluid having at least one target characteristic;

drilling, with drilling equipment, a wellbore; and providing the selected drilling fluid into the wellbore during drilling with the drilling equipment, wherein the at least one target characteristic of the drilling fluid includes an ability of the drilling fluid to penetrate into formation cuttings during drilling to weaken the formation cuttings.

2. The method of claim 1, wherein selecting the drilling fluid comprises selecting the drilling fluid having the following further target characteristic: the drilling fluid does not increase in viscosity under high pressure above a viscosity of the drilling fluid at atmospheric pressure, wherein the high pressure is any pressure greater than atmospheric pressure.

3. The method of claim 1, wherein selecting the drilling fluid comprises selecting the drilling fluid having the following further target characteristic: the drilling fluid does not increase in viscosity with increase in shear experienced by the drilling fluid.

4. The method of claim 1, wherein selecting the drilling fluid comprises selecting the drilling fluid having the following further target characteristic: the drilling fluid exhibits a chemical-mechanical effect to weaken a formation through which the wellbore is drilled.

5. The method of claim 1, wherein selecting the drilling fluid comprises selecting the drilling fluid having the following further target characteristic: the drilling fluid prevents rehealing of the formation cuttings.

6. The method of claim 1, wherein selecting the drilling fluid is based on experimentation.

7. The method of claim 1, wherein selecting the drilling fluid is accomplished by a computer based on input data relating to the one or more criteria and the at least one target characteristic.

8. The method of claim 1, wherein selecting the drilling fluid having the at least one target characteristic based on the one or more criteria comprises selecting a drilling fluid containing cesium formate.

9. The method of claim 1, wherein selecting the drilling fluid based on the one or more criteria comprises selecting the drilling fluid based on one or more of: (1) faster drilling by the drilling equipment; (2) drilling at high pressure, wherein high pressure is any pressure greater than atmospheric pressure; and (3) drilling in a particular formation composition.

10. The method of claim 1, wherein selecting the drilling fluid having the at least one target characteristic based on the one or more criteria comprises selecting a drilling fluid containing only mineral oil.

11. The method of claim 1, wherein selecting the drilling fluid having the at least one target characteristic based on the one or more criteria comprises selecting a drilling fluid containing an additive that contains a metallic oxide.

12. An article comprising at least one computer-readable storage medium containing instructions that when executed cause a computer to:

receive input data relating to one or more criteria relating to drilling of a wellbore, and target characteristics of a drilling fluid; and based on the received input data, selecting a drilling fluid to use with drilling equipment to drill the wellbore, wherein the selected drilling fluid is to be provided into the wellbore during drilling with the drilling equipment, and wherein the target characteristics of the drilling fluid include a chemical-mechanical effect to weaken a formation through which the wellbore is drilled, and at least two characteristics selected from among:

an ability of the drilling fluid to penetrate into formation cuttings during drilling to weaken the formation cuttings, the drilling fluid does not increase in viscosity under high pressure above a viscosity of the drilling fluid at atmospheric pressure, wherein the high pressure is any pressure greater than atmospheric pressure, and the drilling fluid does not increase in viscosity with increase in shear experienced by the drilling fluid.

13. The article of claim 12, wherein the selected drilling fluid contains cesium formate.

14. The article of claim 12, wherein the one or more criteria comprise one or more of: (1) faster drilling by the drilling equipment; (2) reduced cost of drilling fluid; (3) drilling at high pressure, wherein high pressure is any pressure greater than atmospheric pressure; and (4) drilling in a particular formation composition.

15. The article of claim 12, wherein the selected drilling fluid contains only mineral oil.

16. The article of claim 12, wherein the selected drilling fluid contains an additive that contains a metallic oxide.

17. An article comprising at least one computer-readable storage medium containing instructions that when executed cause a computer to:

receive input data relating to one or more criteria relating to drilling of a wellbore, and target characteristics of a drilling fluid; and based on the received input data, selecting a drilling fluid to use with drilling equipment to drill the wellbore, wherein the selected drilling fluid is to be provided into the wellbore during drilling with the drilling equipment, and wherein the target characteristics of the drilling fluid include the prevention of reheating of formation cuttings and at least two characteristics selected from among:

an ability of the drilling fluid to penetrate into formation cuttings during drilling to weaken the formation cuttings, the drilling fluid does not increase in viscosity under high pressure above a viscosity of the drilling fluid at atmospheric pressure, wherein the high pressure is any pressure greater than atmospheric pressure, and the drilling fluid does not increase in viscosity with increase in shear experienced by the drilling fluid.

18. The article of claim 17, wherein the selected drilling fluid contains cesium formate.

19. The article of claim 17, wherein the selected drilling fluid contains only mineral oil.

20. The article of claim 17, wherein the selected drilling fluid contains an additive that contains a metallic oxide.

21. The article of claim 17, wherein the one or more criteria comprise one or more of: (1) faster drilling by the drilling equipment; (2) reduced cost of drilling fluid; (3) drilling at high pressure, wherein high pressure is any pressure greater than atmospheric pressure; and (4) drilling in a particular formation composition.

* * * * *